US006227707B1

(12) United States Patent
Anderson

(10) Patent No.: US 6,227,707 B1
(45) **Date of Patent: *May 8, 2001**

(54) FLEXIBLE BAG WITH DETACHABLE SECTION

(76) Inventor: Ron E. Anderson, P.O. Box 8445, 17625 E. Railroad St., City of Industry, CA (US) 91748-0445

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/113,022

(22) Filed: Jul. 13, 1998

(51) Int. Cl.[7] ..... B65D 33/00
(52) U.S. Cl. ..... 383/127; 206/831
(58) Field of Search ..... 383/126, 127; 229/70; 206/831

(56) References Cited

U.S. PATENT DOCUMENTS

| | | | | |
|---|---|---|---|---|
| 1,029,784 | * | 6/1912 | Appel | 383/126 |
| 3,183,614 | * | 5/1965 | Loderhouse | 206/831 |
| 3,804,323 | | 4/1974 | Bemel . | |
| 3,968,927 | * | 7/1976 | Katz et al. | 229/70 |
| 5,025,980 | * | 6/1991 | Blackman | 229/70 |
| 5,163,756 | | 11/1992 | Riseman . | |

FOREIGN PATENT DOCUMENTS

| | | | | |
|---|---|---|---|---|
| 2074541 | * | 11/1981 | (GB) | 383/127 |

* cited by examiner

*Primary Examiner*—Stephen P. Garbe
(74) *Attorney, Agent, or Firm*—James E. Brunton, Esq.

(57) ABSTRACT

A flexible bag has a readily detachable section defined by lines of perforation, which perforation lines are defined either in a flap panel attached at its opposite edges to a back panel and overlying the back panel, or in a back panel overlying the flap panel with the flap panel attached at its opposite edges to the back panel.

21 Claims, 2 Drawing Sheets

FLEXIBLE BAG WITH DETACHABLE SECTION

BACKGROUND AND SUMMARY OF THE INVENTION

Flexible bags are utilized for many purposes, and typically with retail merchandise, carryout food items, fast food, etc. Such bags are generally fabricated of paper by conventional automated machinery and equipment, which provides rapid, continuous production. Little change is required in such machinery and equipment to produce virtually any particular type of bag of the general type.

Detachable sections, such as coupons and the like, have long been provided on cartons, envelopes and flexible bags. Such detachable or tear-away sections may contain advertising material, communications, stamps, coupons, etc. The detachment of such sections left sizable, undesirable openings in bags which interfered with their containment function.

Detachable sections may be utilized by customers in obtaining purchase discounts or other proposed arrangements, may contain particular advertising matter, and may serve other purposes, such as providing receipts, numbering systems, inventory control, etc.

Bags with detachable sections are the subjects of U.S. Pat. No. 3,804,323 to Bemel, and U.S. Pat. No. 5,163,756 to Riseman (Bagcraft Corp.). The Riseman patent relates to a flexible bag with a detachable coupon section on a flap attached at an edge thereof by an adhesive seam, with the outer edge of the flap unsecured. Detachment of the coupon section and its removal leaves no opening in the bag and does not affect the utility of the bag in retaining contents, etc. The coupon section can be removed before or after utilizing the bag contents. However, with the flap being attached only along one edge, the flap is loose and subject to undesirable interference with equipment used to produce the bags or in assemblying and packaging bags. An example is that vacuum suction apparatus or suction cups can engage a flap, as when moving a bag in production, removing from a machine, or pulling a bag from a stack, the rest of the bag being dragged or lifted by the flap, thereby causing jamming of equipment, complications in operation, or other interference with equipment or procedures.

The present invention provides a flexible bag having a detachable section having the advantages of the above-mentioned prior art bags, and without the disadvantages thereof. The bag of the invention comprises front, back and side panels, a bottom panel and a flap panel extending from a side panel and extending partially across the back panel, being secured to the back panel at the flap panel outer edge and may be secured to the back panel from the opposite edge of the flap panel adjacent the juncture of the flap panel with the side panel. A detachable section is defined by perforation lines, including two spaced-apart generally parallel lines, and a perforation line transverse to the spaced-apart lines. The perforation lines may be defined in the back panel in embodiments wherein the back panel overlies the flap panel, and the perforation lines may be defined in the flap panel in an embodiment wherein the flap panel overlies the back panel. The flap panel may preferably extend about half the width of the back panel. The bag is preferably formed of a blank having folded score lines defining respective panels, fold lines and the detachable section.

DESCRIPTION OF THE PREFERRED EMBODIMENTS

Figure 1:
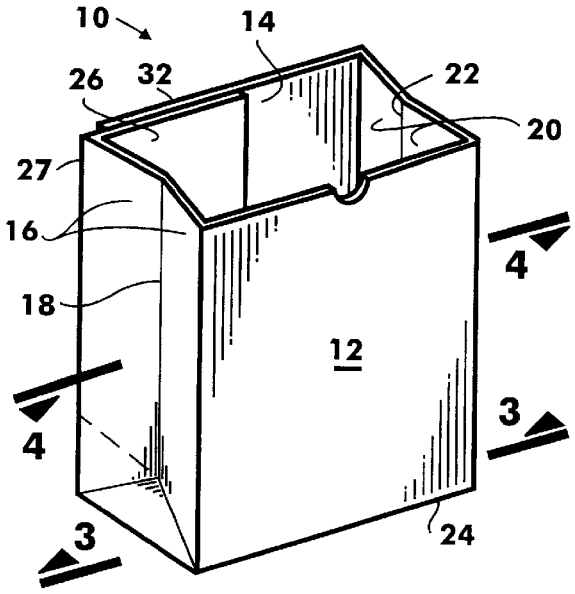
FIG. 1 is a perspective view of a preferred embodiment of the flexible bag of the invention with a detachable section.

Referring to the drawings, FIGS. 1 through 4 illustrate a preferred embodiment 10 of the invention, which comprises a front panel 12, a back panel 14, a first side panel 16 with a gusset fold line 18, a second side panel having a gusset fold line 22, a bottom 24, and a flap panel 26 which extends from fold line 27 connecting it to side panel 16. Adhesive strips (not shown) along the outer edge portion of the flap panel, and its edge portion adjacent the back panel, secure the flap panel to the back panel.

Perforation lines 36, 38 are spaced inwardly of the edges of the back panel and extend in generally parallel relation from the upper edge of the back panel to intersect a transverse perforation line 39 spaced a short distance from the bottom edge of the back panel.

Figure 3:
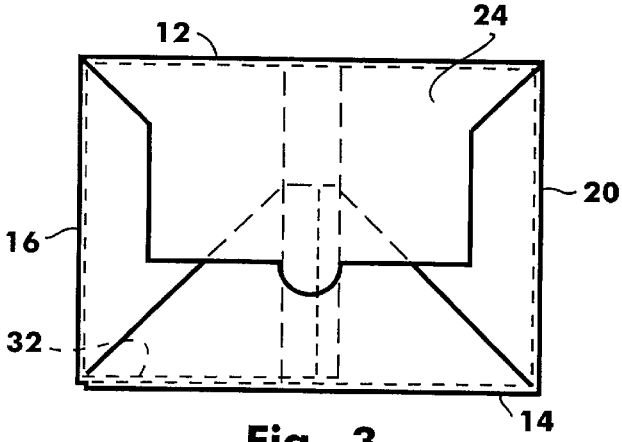
FIG. 3 is a bottom view taken at line 3—3 in FIG. 1.
Figure 4:
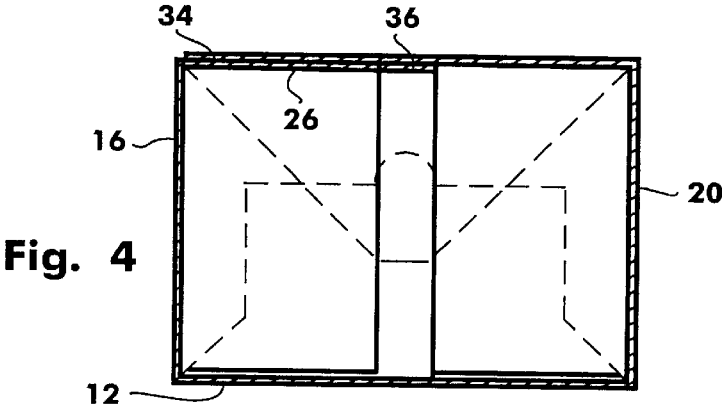
FIG. 4 is a sectional view taken at line 4—4 in FIG. 1.
Figure 7:
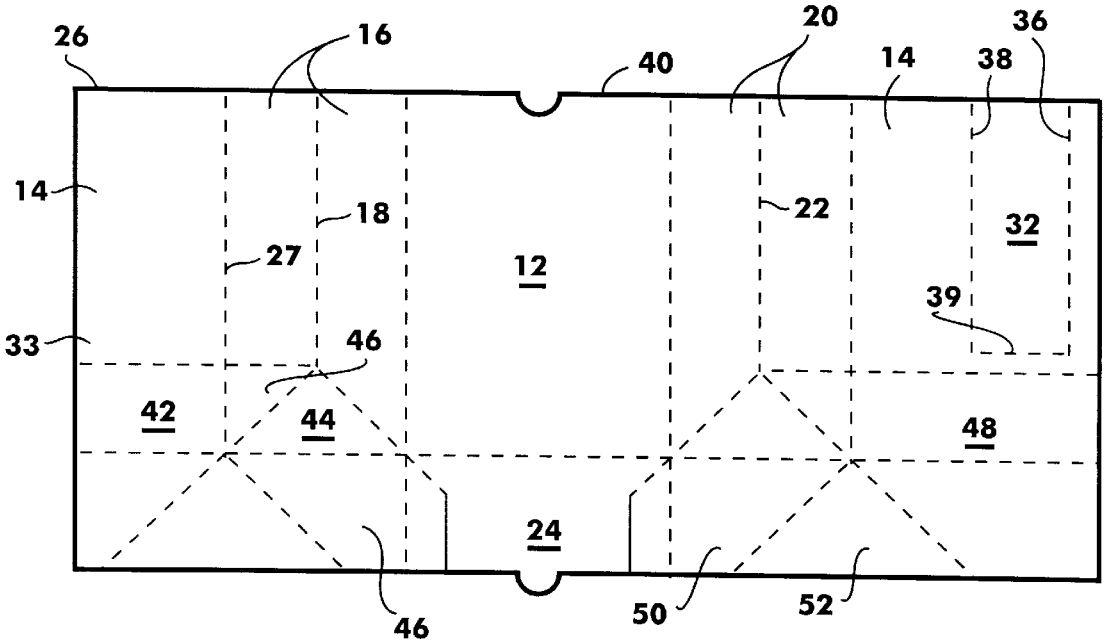
FIG. 7 is a plan view of a blank for the fabrication of the flexible bag according to the invention.

Bottom 24 is formed of sections extending from the above-described panels. As shown in FIGS. 3 and 7, these sections include section 42 extending from flap panel 26, sections 44, 46 extending from the side panels, section 48 extending from the back panel 14, and section 50 extending from side panel 16 and back panel 14. The extended sections are overlapped and folded to define the bag bottom, as is generally conventional.

Figure 5:
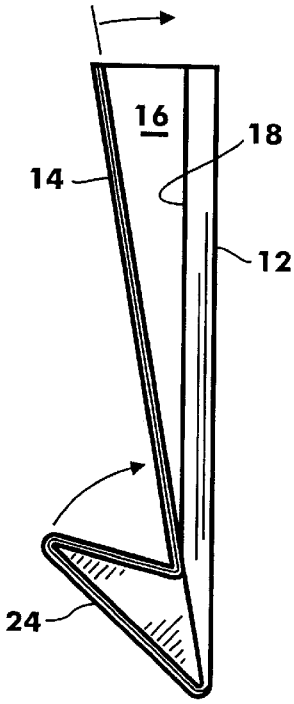
FIG. 5 is a side elevational view of the bag of FIG. 1, showing the bag during folding between open and closed configurations of the bag.

The gusseted side panels enable the bag to be folded to a bag-closed position and opened to its open configuration. The bottom 24 is foldable against a back panel, such as panel 14, as indicated in FIG. 5, wherein the bag is shown in an intermediate configuration between its open and closed configurations.

A feature of the present invention is the flap panel being secured at its outer edge to the back panel 14 by adhesive line strips (not shown.). The opposite edge portion is secured by an adhesive strip between it and the edge portion of the back panel adjacent the side panel 16 from which the flap panel extends.

A separable coupon or section 32 is defined by perforation lines in the back panel 14, with generally parallel perforation lines extending from the upper edge of the back panel and intersecting transverse perforation line 39 which is spaced from the bottom edge of the back panel. The coupon is readily detachable at the perforated strips by manual grasping of the upper edge portion of the flap panel and pulling it from the back panel.

Figure 6:
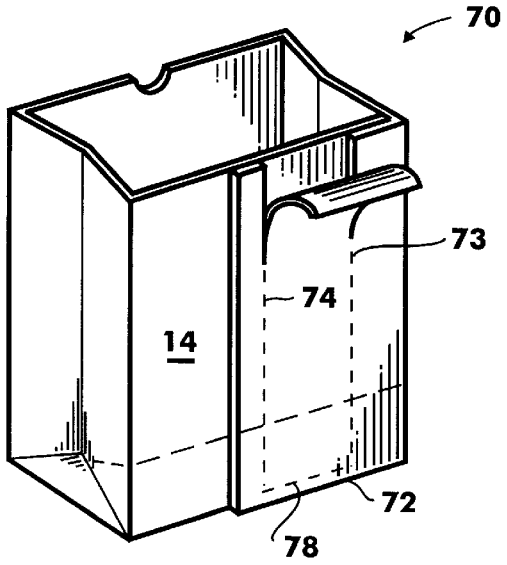
FIG. 6 is a perspective view, similar to the view of FIG. 2, showing a modified form of the bag of the invention with a detachable section partially detached from the bag.

FIG. 6 illustrates a second embodiment 70 of the invention wherein a flap panel 72 is disposed in overlying relation relative to the back panel. The perforation lines defining the detachable coupon are defined in the flap panel 72. The parallel perforation lines 73, 74 extend from the upper edge of the flap panel to intersect a transverse perforation line 78 spaced from the bottom edge of the flap panel.

Figure 2:
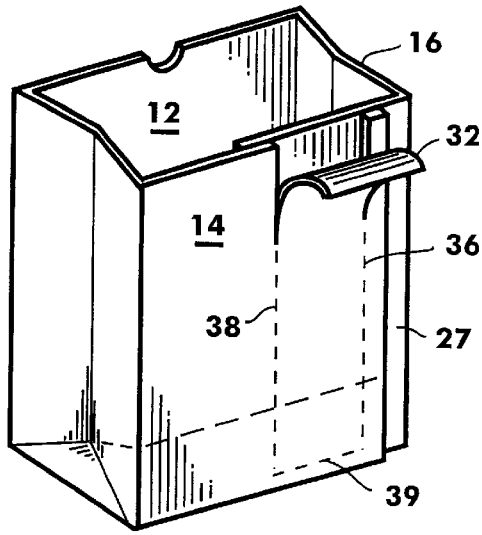
FIG. 2 is a perspective view oppositely from the view of FIG. 1, and showing a detachable section partially detached from the bag.

A blank for forming the flexible bag of FIGS. 1 and 2 comprises a plurality of panels defined by fold and score lines. These panels include front panel 12, back panel 14, side panels 16, 20 having gusset fold lines 18, 22, respectively, flap panel 26, and a bottom panel, extended sections of certain of said panels, including sections 42, 44, 46, 48, 50 and 52, are defined and are foldable to cooperate to form the bottom panel.

The flap panel 26 extends from a fold line 27 with a side panel, and is adapted to extend across the back panel for part of the width of the back panel. A detachable section 32 is defined by parallel perforation lines 36, 38 on the back panel.

The blank (not shown) for the fabrication of the bag according to the embodiment of FIG. 6 differs somewhat from the blank utilized in the fabrication of the bag of FIGS. 1 and 2.

Thus there has been shown and described a flexible bag with detachable section which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

The inventor claims:

1. A flexible bag having a detachable section, the bag comprising:

a front panel, a back panel, two side panels, a bottom panel, and a flap panel extending from one of the side panels partially across the back panel, the flap panel having an upper edge and an edge adjacent said one of the side panels, the relationship between the flap panel and the back panel being one of (a) the back panel overlying the flap panel and having defined thereon two spaced-apart perforation lines defining the detachable section and extending substantially perpendicular to and between the flap panel upper edge and said bottom panel, (b) the flap panel overlying the back panel and having defined thereon two spaced-apart perforation lines defining the detachable section and extending substantially perpendicular to and between the flap panel upper edge and said bottom panel.

2. A flexible bag according to claim 1, wherein:

said detachable section is defined by said two spaced-apart perforation lines extending in generally parallel relation, and a perforation line transverse to the spaced-apart lines and spaced from one of (a) said back panel bottom edge, (b) said flap panel bottom edge.

3. A flexible bag according to claim 1, wherein said flap panel extends about half the width of the back panel.

4. A flexible bag according to claim 1, wherein each of the side panels has a gusset fold to facilitate folding and unfolding of the side panels for movement of the bag between its closed and its open configurations.

5. A flexible bag according to claim 1, wherein the bottom panel is disposed generally transversely of the other panels when the bag is in its open configuration.

6. A flexible bag according to claim 1, wherein the bag is formed of a unitary blank folded to define said back panel, front panel, two side panels, a flap panel, and a bottom.

7. A flexible bag comprising:

a plurality of panels including front, back, bottom, and two side panels, a flap panel extending from its juncture with one of the side panels partially across and underlapping the back panel, and a detachable section defined on the back panel by two spaced-apart perforation lines extending substantially perpendicular to and between the flap panel upper edge and said bottom panel, an end edge of the flap panel being attached to the back panel by adhesive.

8. A flexible bag according to claim 7, wherein: the detachable section is defined by two spaced-apart perforation lines extending in generally parallel relation, and a perforation line transverse to the spaced-apart lines and spaced from a bottom edge of the back panel.

9. A flexible bag according to claim 7, wherein: the flap panel extends about half the width of the back panel.

10. A flexible bag according to claim 1, wherein: said bag is formed of a unitary blank folded to define said panels and a bottom.

11. A flexible bag according to claim 1, wherein: each of the side panels has a gusset fold to facilitate the folding and unfolding of the side panels for movement of the bag between its closed and its open configurations.

12. A flexible bag according to claim 1, wherein: the bottom panel is disposed generally transversely of the other panels when the bag is in its open configuration.

13. A flexible bag comprising:

a plurality of panels including front, back bottom, and two side panels, a flap panel extending from one of the side panels and overlying the back panel plurality across the back panel, and a detachable section defined on the flap panel by two spaced-apart performation lines extending substantially perpendicular to and between the flap panel upper edge and said bottom panel, and said flap panel having its end edge attached to the back panel by adhesive.

14. A flexible bag according to claim 13, wherein said flap panel extends about half the width of the back panel.

15. A flexible bag according to claim 13, wherein: said detachable section is defined by two spaced-apart perforation lines extending in generally parallel relation, and a perforation line transverse to said spaced-apart lines and spaced from the bottom edge of the flap panel.

16. A flexible bag according to claim 13, wherein said flap panel is attached to the back panel by an adhesive strip between the flap panel and the back panel adjacent its juncture with said one of the side panels.

17. A flexible bag according to claim 13, wherein each of the side panels has a gusset fold to facilitate the folding and unfolding of the side panels for movement of the bag between its closed and open configurations.

18. A flexible bag according to claim 13, wherein the bag is formed of a unitary blank folded to define said panels and the bottom.

19. A blank for forming a flexible bag, comprising:

a plurality of panels defined by fold and score lines, said panels including front, back, sides, flap, and bottom panels, extended sections of certain of said panels being defined and foldable to cooperate to form the bottom panel, said flap panel extending from a fold line within a side panel and being adapted to be coextensive for part of the width of the back panel, and a detachable section defined by two spaced-apart perforation lines on one of (a) the flap panel, (b) the back panel, and said perforation lines extending substantially perpendicular to and between the flap panel upper edge and said bottom panel.

20. A blank according to claim 19, wherein said perforation lines comprise two generally parallel perforation lines and a perforation line transverse to the parallel perforation lines.

21. A blank according to claim 19, and further including a gusset fold line disposed centrally on each side panel.

* * * * *